United States Patent [19]

Winterhalter et al.

[11] 4,273,182

[45] Jun. 16, 1981

[54] CORE ASSEMBLY AND THE METHOD OF MAKING AND USING SUCH ASSEMBLY

[75] Inventors: Donald L. Winterhalter; Conrad G. Perkey, both of Dearborn Heights, Mich.

[73] Assignee: Ford Motor Company, Dearborn, Mich.

[21] Appl. No.: 101,311

[22] Filed: Dec. 7, 1979

[51] Int. Cl.[3] ..... B22C 9/10; B22D 33/04

[52] U.S. Cl. ..... 164/137; 164/369

[58] Field of Search ..... 164/137, 369, 361, 364–368, 164/34, 246

[56] References Cited

U.S. PATENT DOCUMENTS

| | | | |
|---|---|---|---|
| Re. 26,381 | 4/1968 | Thiem et al. | 164/137 X |
| 2,783,510 | 3/1957 | Dolza et al. | 164/137 |
| 2,831,225 | 4/1958 | Kolbe et al. | 164/137 X |
| 3,110,942 | 11/1963 | Thiem et al. | 164/6 |
| 3,264,693 | 8/1966 | Flitz | 164/368 |

*Primary Examiner*—Robert D. Baldwin
*Assistant Examiner*—J. Reed Batten, Jr.
*Attorney, Agent, or Firm*—Joseph W. Malleck; Olin B. Johnson

[57] ABSTRACT

A method of making metal castings is disclosed, and particularly a method for making ferrous castings employing multiple component sand core assemblies. The core assembly is devised to receive a disintegratable strap about one annular outer surface path of the assembly. The strap is drawn tight about the assembly by an automated strapping machine and fused to provide a positive mechanical securement. The strap is preferably arranged coplanar with the outer surface of core prints when used in the assembly. The strapped assembly is placed in any desired orientation within a bonded sand mold and molten metal introduced therein. The molten metal heats the mold and core surfaces and surrounding sand body to such an extent that the strap is volatilized immediately after the introduction of the molten metal.

9 Claims, 8 Drawing Figures

CORE ASSEMBLY AND THE METHOD OF MAKING AND USING SUCH ASSEMBLY

BACKGROUND OF THE INVENTION

Increasingly, a multiple number of sand cores are used in a built-up core assembly in the casting of automotive parts. Heretofore, cores have been designed to fit one upon another when being used in a built-up assembly and have typically rested loosely keyed together. This mode was acceptable because automotive castings were generally designed with sufficient bulk that the ultimate casting tolerated some limited inaccuracy from core shift during metal pouring. However, with modern restrictions being placed on automotive components as to weight, castings must be designed with maximum leanness and thus core shifting or inaccuracies cannot be tolerated.

The prior art has in certain instances locked core assemblies together in critical requirement type casting by the use of principally two modes. One mode has involved pasting the core components together and then subjecting the assembled cores to an oven drying operation for completing the attachment. This method requires an extra step with respect to dipping the core components in a paste tank and, of course, the subsequent oven treatment; the cost of oven equipment used to dry the paste is undesirable. These steps increase manpower and time requirements.

The other mode has involved use of discardable bolts and nuts to clamp the sand core assembly together. Bolt openings are typically formed in the assembly to extend entirely therethrough. This system is disadvantageous because the bolts must be removed after the casting is produced, which is quite difficult and arduous when carrying out core removal. Frequently, the bolts are not removed because they have become fused with the casting. Scrap rates are increased and material handling is excessive.

SUMMARY OF THE INVENTION

This invention relates to foundry techniques for making metal castings and particularly to a method of preparing a multiple component sand core assembly used to complete the molding cavity for a metal casting such as an engine block. In this invention, one uses individual cores or core assembly components, typically of bonded sharp sand, which can be selectively distintegrated, as by vibration after the casting is completed. After having assembled the cores for use as a unit, the unit is secured by at least one annular strap tightly binding the unit. The strap is constituted of a material that is dissipated by the heat of the molten metal in the molding cavity in which the unit is placed.

In one preferred mode, at least some of the cores are carried by core prints. The core prints are constructed to carry a groove around their outer surface and cooperate in defining an annular path to receive the strap in a recessed condition. The groove is designed to snugly accept the disintegratable strap so that it is in a manner coterminus with the exposed surface of the core print. The strap may be tightened in place about the core assembly by heat fusing the overlapped portions of a severed strand from which the strap is formed. The strap may be tightened about the core assembly and secured by mechanically fusing the two layers of strap material at the point of overlap. The core assembling process is thus simplified and made less costly and defective castings are reduced as a result of less core movement and better cleaning of the finished casting.

DETAILED DESCRIPTION

An exemplary method for carrying out the present invention for making metal castings is as follows.

(1) A plurality of individual sand core components are made to nest together in an assembly to be used as a single unit in a metal casting operation. The components are bonded sand cores which are selectively disintegratable by mechanical impact or vibration to remove the cores from a completed metal casting. In this example, four individual core components are here prepared, including a journal core A, a crankcase and barrel core B, a water jacket core C, and a head slab core D. These cores are used in defining the internal passages and spaces that are necessary for an internal combustion engine block. The cores are formed of a suitable sand mixture employing a binder, preferably in the form of a furan resin, which when cured by heat forms a rigid sand structure. Other binders may be employed which are cured without the use of heat to achieve equivalent purposes.

The technology for making sand cores is more fully disclosed in *Foundry Core Practice*, by Harry Gietert, published by The American Foundrymen's Society, 1966, and which is incorporated herein by reference. Such technology typically comprises blowing the sand mixture into a core box having an appropriate interior cavity designed for the specific core; the impaction from blowing forces the sand grains into a dense condition.

In many multiple component core assemblies it is necessary to provide at least some of the cores with core prints. A core print is a segment of bonded sand which forms part of the mold body and is integrally formed with the sand core. Such core print gives support to the core and must fit snugly into a space left vacant in the mold body defining the casting cavity. Since the presence of a superimposed strap on such prints would inhibit a proper fit with the major mold body, a recess for such strap is employed. In the illustrated example, cores A, C and D have all or some part which is a core print. It is preferred to form a recess or imprinted groove in the exposed outer surface of such core prints to receive the binding strap, the use of which is described in the next steps.

To form such groove, the core box is provided with a rib to define a groove imprint 9 along a selected path. The groove is arranged to provide an annular recess around the entire core assembly or cluster when all the cores are put in their proper relationship. This is made possible by the use of core prints that surround the core assembly along one annular path. In core assemblies that do not have a surrounding core print or prints, the strap may engage the interior core elements directly without the necessity for a recess.

Figure 1:
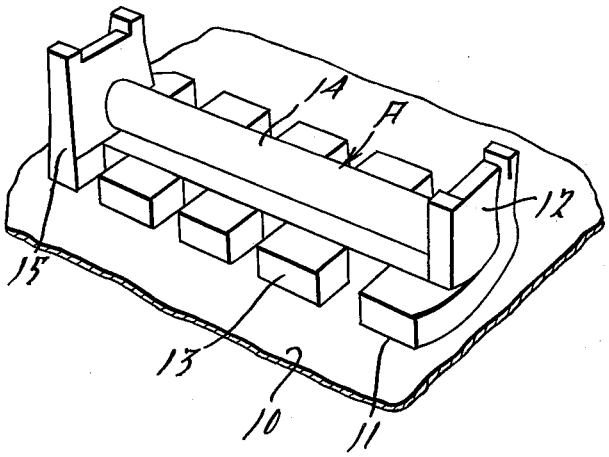
FIGs. 1-6 are perspective elevational views (some exploded) showing in sequence the different steps of assembling a multiple component sand core assembly in accordance with the principles of the present invention.
Figure 2:
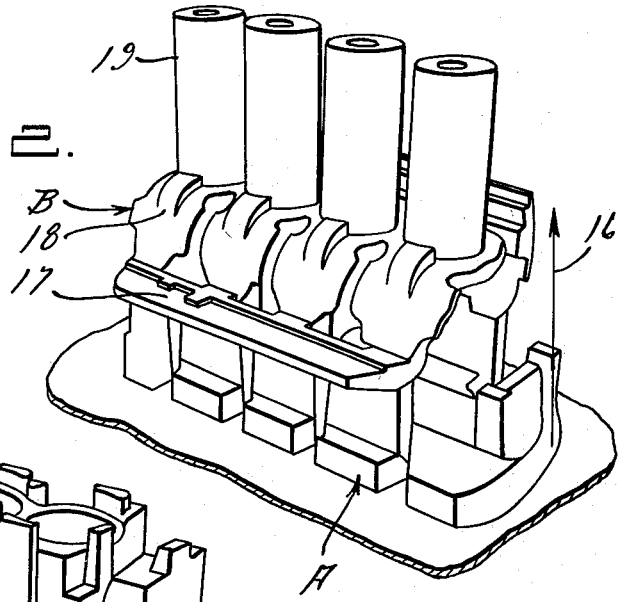
Figure 3:
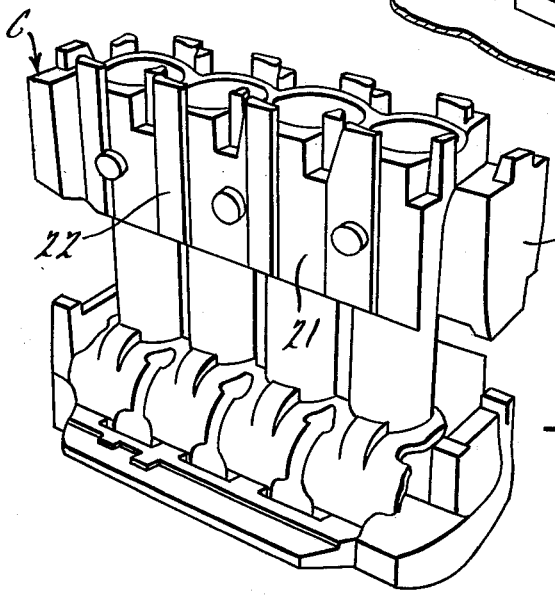
Figure 4:
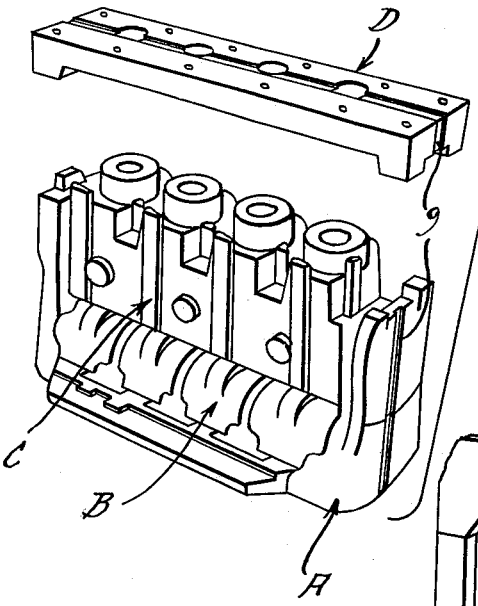

The cured cores are then removed from their core boxes and assembled as shown in the sequence of FIGS. 1-6. First the journal core A is placed on a platform 10 with its base surface 11 resting thereon. The journal core comprises shaft space part 14, locator space part or print 13, and end wall prints 12 and 15. The next core (the crankcase and barrel core B) is placed thereover in spaced relationship with the journal core. The cores A and B are stacked on top of one another as shown in FIG. 2 in a preferred orientation 16 which is vertical to the platform upon which the journal core rests; the cores A and B are shown separated to illustrate the direction of nesting. Core B comprises cylinder bore parts 19, crankcase cavity space parts 18, and locator flange space parts 17. Core C comprises water jacket parts 21, water circulation opening parts 22, and end locator parts or prints 20. Core D is an entire print or slab with a depending skirt and rests on the upper portion of assembled cores B and C. The interrelated cores can be lifted using core A as a support beneath the assembly. Should the assembly be tilted or placed in an angled position, the cores would not retain their relationship, as they are not positively locked together.

Figure 5:
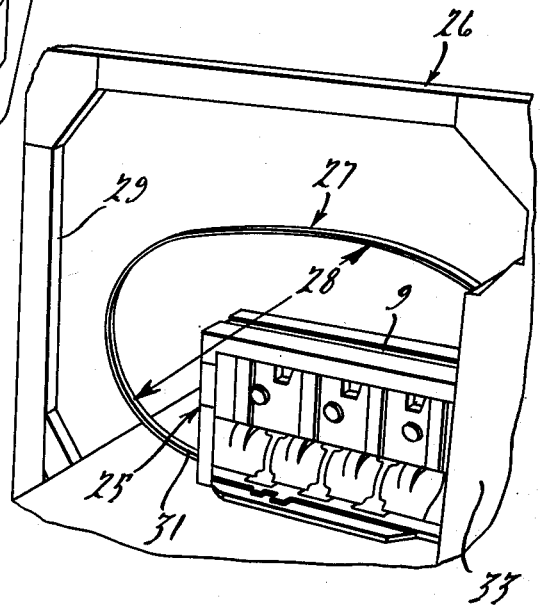
Figure 6:
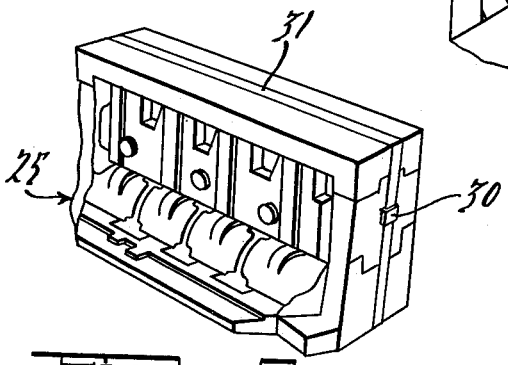
Figure 8:
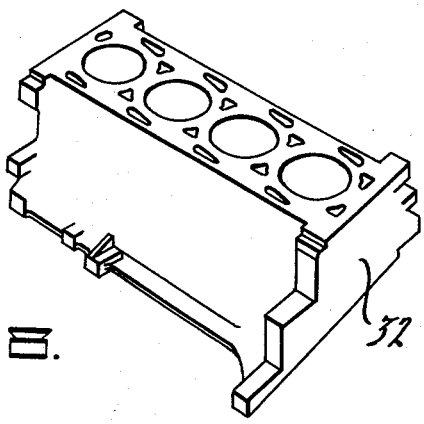
FIG. 8 is a perspective view of a metal casting produced utilizing the core assembly of FIG. 6.

(2) As shown in FIG. 5, the nested core assembly or cluster 25 is next stationed for service in a strapping machine 26. A loop of strap material 27 is formed of sufficient interior dimension 28 so that the core assembly 25 can be placed therein without interrupting the strap. The strap loop 27 is formed by the machine employing a feeding mechanism 33 which draws a continuous strand 31 of strap material from a reel (not shown), feeds the strand along a track 29 which causes the strap material to return upon itself back into the feeding mechanism 33 where the leading end is spliced to the main strand and then the loop is severed from the strand. The strap loop is drawn tight (by means in the feeding mechanism 33) around the core assembly. Care is taken to insure the strap fits down into the groove imprint 9 if such groove has been provided on the core assembly. The splice is provided by overlapping the strand upon itself while taut against the assembly and applying pressure and heat at the juncture of overlap 30 to mechanically fuse the overlapping materials together. The strap is maintained snug about the core assembly during splicing by mechanical gripping means (not shown).

The strap material is formed of a disintegratable material that can be vaporized and consumed at a temperature of 300°-500° F. which is typically the wall temperature of the mold (to a depth of 2-3 inches) when pouring ferrous castings. If metal castings, other than iron, are poured, the selected strap material must be vaporizable at the temperature experienced with such operation. Such disintegratable material may comprise polypropylene, polyethylene, polyisobutylene, or other equivalent plastic that can be vaporized at such wall temperature. Metal straps are not suitable since they have a melting temperature far in excess of that which would allow them to be properly consumed during a typical metal casting operation.

When groove imprints are used to recess the strap, the strap should have a cross-sectional dimension that is substantially identical to the cross-sectional dimension of the groove imprint within the selected outer surfaces of the core assembly. This enables the strap to be an integral member of the core assembly without permitting any unwanted additional cast flanges to form by molten metal penetrating into the groove imprint and thus interrupt the desired configuration of the resulting casting 32. In essence, the plastic strap becomes an integral part of the core and is not excess to be merely tolerated.

Figure 7:
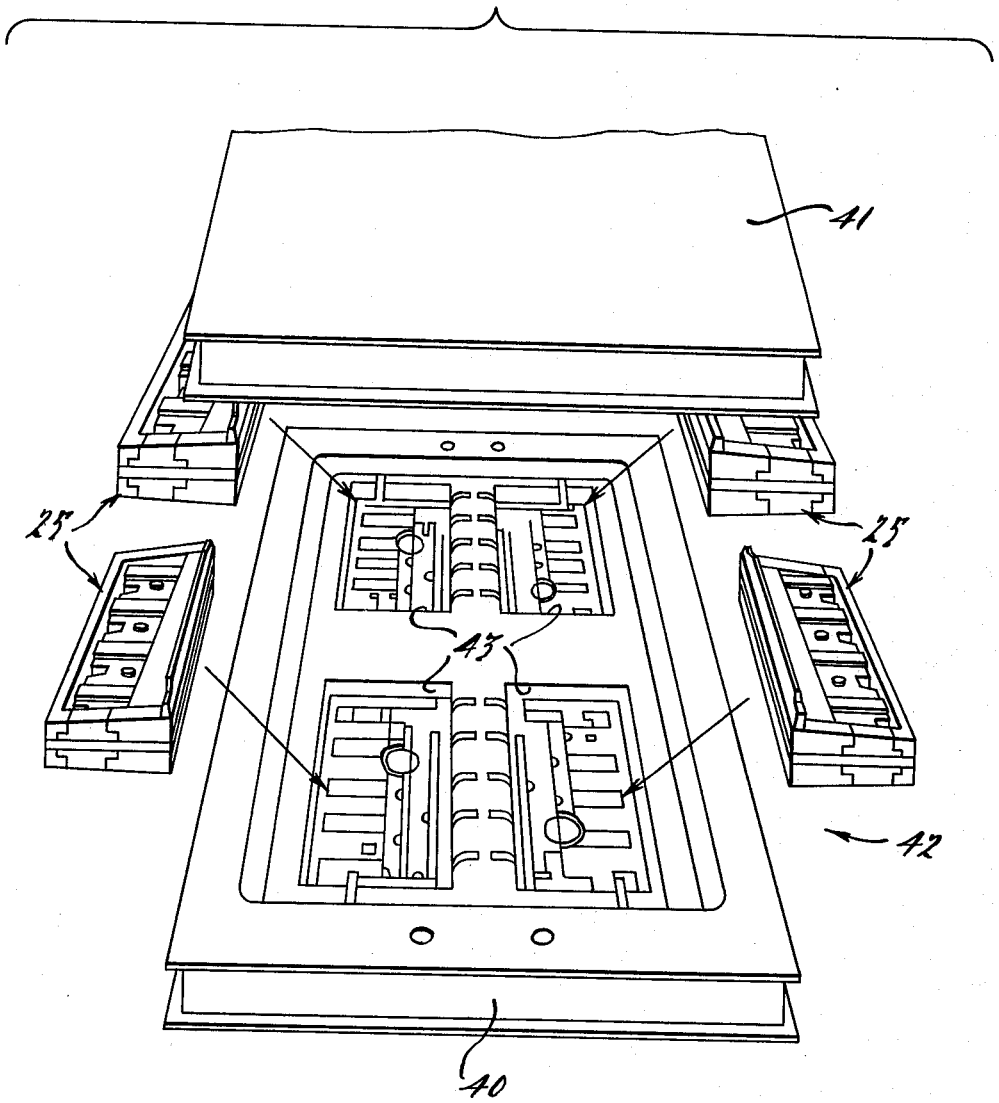
FIG. 7 is an exploded perspective view of a casting mold ready for reception of a plurality of completed sand core assemblies.

(3) In the illustrative example, the strapped core assembly is turned on its side and placed into a preset fixture (not shown) which orients and locates the core assemblies for transfer to the drag mold. The core assemblies are then transferred in this preset relation from the preset fixture to the drag mold by means of a setting fixture. The setting fixture accurately locates and places each core assembly into its drag mold cavity without damaging the walls of the mold cavity. As shown in FIG. 7, the mold 42 has a drag 40 and cope 41 designed to receive four core assemblies placed on their sides with the stacked direction of the assemblies being horizontal. Suitable sprues and runners are designed into the mold to feed molten metal to the four mold cavities 43 which have the core assemblies 25 set thereinto. Molten metal, having a metal temperature typically of 2550°-2700° F., is poured into the top of the mold. The sand or mold walls, including the core prints, are heated by such molten ferrous material to a depth of at least three inches to a temperature generally in the range of 450°-500° F. Considerable heat is conducted into the interior mass of the mold and the core assembly therefore experiencies the necessary disintegrating temperature. The plastic strap material is, of course, vaporized by the heat either at such depth in the mold wall or by direct contact with the molten metal. Upon solidification of the casting, the sand core material is stripped from the casting by a suitable vibration or mechanical impact causing the sand grains to unlock or break apart and substantially flow out leaving the casting 32 in a clean defined condition.

The completed strapped core assembly is an intermediate product that has several advantages. The nested assembly is comprised of a plurality of bonded sand cores, at least some of which have core prints in which a recess is formed along the print outer surface to cooperate in defining a circuitous path about the core assembly. A continuous strap loop is disposed in the recess and tightly binds the assembly. The strap consists of a material that disintegrates by the heat experienced at the core print outer surface during an intended metal casting operation.

If certain defects are noted in certain cores after assembly, the cluster can be destrapped and the defective core replaced without scrapping the entire cluster as necessitated by the prior art methods. The core assembly is considerably less costly to fabricate than pasted or bolted assemblies and alignment between cores is truer. Moreover, this assembly is not limited as to size and as to orientation in the mold.

We claim:

1. A method of making a metal casting, comprising:

(a) assembling for use as a unit a plurality of selectively disintegratable cores;

(b) securing said unit by at least one annular strap tightly binding said unit, said strap consisting of a material that is dissipatible by the heat of the metal to be cast; and (c) placing said unit in a mold and pouring molten metal thereinto to form a casting while dissipating said strap.

2. The method as in claim 1, in which said molten metal is ferrous based and said strap material consists of a plastic which is volatilized at a temperature of at least 500° F.

3. The method as in claim 1, in which said strap is comprised of a continuous strand of said material having parts which are overlapped to form a loop closed about the unit; when the loop is tightened, the overlapping parts of the strap are adhered together by deformation and pressure to provide a splice at the juncture of overlap.

4. The method as in claim 1, in which said molten metal is ferrous based and said cores and mold are formed of bonded sand, certain of said cores carrying core prints defining part of the mold, said strap predominantly engaging the print of said cores, and the molten ferrous based metal heating the core prints to a temperature of at least 500° F. to disintegrate and vaporize said strap.

5. A method of making a metal casting, comprising:

(a) assembling for use as a unit a plurality of sand cores which can be nested one to another to form a cluster, said cluster having core prints along one annular exterior path and said core prints having an imprinted shallow recess of predetermined cross-section forming a continuous groove across an outer surface of said core prints to receive a strap therein having a complimentary cross-section;

(b) wrapping a strap in and along said groove, said strap residing totally within the defined groove of said core assembly and being constituted of a heat dissipatible material having a melting temperature which is below the temperature of the core surface in contact therewith when said unit is in a mold and molten metal is introduced into said mold;

(c) placing said unit in a mold in a predetermined orientation and pouring molten metal thereinto to form a casting while dissipating said strap.

6. The method as in claim 5, in which said heat dissipatible material is selected from the group comprising polypropylene, polyethylene and polyisobutylene.

7. The method as in claim 5, in which step (c) is carried out by the use of a machine which permits said core unit to be moved into a service position, a loop is first formed from an overlapping strand of said strap material and placed about said unit in spaced relationship therefrom, while said core unit is in said service position the strap loop is drawn snugly about said unit and spliced at the strand overlap while severing the loop from the strand.

8. The method as in claim 6, in which said splice is formed by a combination of heat and mechanical deformation of a plurality of fingers through said overlap.

9. A core assembly comprising:

(a) a plurality of bonded sand cores forming a nested core assembly, at least some of said cores having core prints in which a recess is formed about the print outer surface to cooperate in defining a circuitous path about said core assembly;

(b) a continuous strap loop disposed in said recess and tightly binding said assembly, said strap consisting of a material disintegratable by heat experienced at the core print surface during an intended metal casting operation with said core assembly.

* * * * *